United States Patent [19]

Javorik

[11] Patent Number: 4,685,323

[45] Date of Patent: Aug. 11, 1987

[54] METHOD FOR INCREASING THE BUCKLING LOAD CAPACITY AND THE COMPREHENSIVE AND TENSILE PROPERTIES OF A COLUMN

[75] Inventor: Laszlo Javorik, Oregon, Ill.

[73] Assignee: Grotnes Metalforming Systems, Inc., Chicago, Ill.

[21] Appl. No.: 808,669

[22] Filed: Dec. 13, 1985

Related U.S. Application Data

[63] Continuation of Ser. No. 574,282, Jan. 26, 1984, abandoned.

[51] Int. Cl.[4] ..... B21J 5/06

[52] U.S. Cl. ..... 72/354; 72/359; 72/377

[58] Field of Search ..... 29/155 R, 155 C; 72/354, 357, 359, 367, 370, 377

[56] References Cited

U.S. PATENT DOCUMENTS

| | | | |
|---|---|---|---|
| 724,270 | 3/1903 | Ehrhardt | 72/357 |
| 812,856 | 2/1906 | Loss | 72/357 |
| 1,571,737 | 2/1926 | Schanandoah | 72/377 |
| 2,178,141 | 10/1939 | Frame | 29/156 |
| 2,755,545 | 7/1956 | Moore | 72/364 |
| 3,224,243 | 12/1965 | Van Deberg | 72/354 |
| 3,328,996 | 7/1967 | Pon et al. | 72/369 |
| 4,028,926 | 6/1977 | Olesovsky | 72/422 |
| 4,179,915 | 12/1979 | Huydts | 72/367 |
| 4,218,908 | 8/1980 | Frantz et al. | 72/302 |
| 4,364,251 | 12/1982 | Nishihara | 72/58 |

FOREIGN PATENT DOCUMENTS

| | | | |
|---|---|---|---|
| 584750 | 1/1947 | United Kingdom | 72/377 |

*Primary Examiner*—Lowell A. Larson

*Attorney, Agent, or Firm*—Marshall, O'Toole, Gerstein, Murray & Bicknell

[57] ABSTRACT

In accordance with the present invention, there is provided a method for increasing the longitudinally compressive and tensile proportionality limits and ultimate strengths of an elongated structural member by applying to the member a longitudinally compressive load. To increase the proportionality limits of the member, a longitudinally compressive load is applied to the member which is close to its maximum load. In order to prevent buckling of the member under such a load, the member is confined in an encasement which allows the member to yield longitudinally without bending. By applying to the member a longitudinally compressive load much greater than the member's original (i.e., untreated) ultimate compressive strength, both the ultimate strengths and the proportionality limits of the member are increased. In addition, application of a longitudinally compressive load close to or greater than the original ultimate compressive strength of the member also increases the straightness of the member and frees the member of residual stresses.

18 Claims, 9 Drawing Figures

METHOD FOR INCREASING THE BUCKLING LOAD CAPACITY AND THE COMPREHENSIVE AND TENSILE PROPERTIES OF A COLUMN

This application is a continuation, of application Ser. No. 574,282, filed Jan. 26, 1984, now abandoned.

FIELD OF THE INVENTION

This invention relates generally to a method of increasing the longitudinally compressive and tensile proportionality limit of an elongated structural member.

BACKGROUND

Resistance to buckling is an important quality for many elongated structural members used under compressive loads. By improving resistance to buckling, better compressive load performance can be achieved. In addition, increased resistance to buckling allows smaller, and therefore lighter and less expensive, members to be advantageously used in applications where these qualities are important. Consequently, extensive studies have been made of how to improve the buckling resistance of elongated structural members under compressive loads.

Typically, the prior art has attempted to improve buckling resistance by applying radially compressive loads in order to increase the straightness of an elongated structural member (i.e., column). For example, U.S. Pat. No. 2,178,141 to Frame discloses the cold-straightening of well casings by applying radially compressive loads incrementally and progressively along the casing length. As a result of the radial compression, residual stresses in the casing are reduced, giving them an increased resistance to buckling.

SUMMARY OF THE INVENTION

It is the primary object of this invention to provide a method of cold-working elongated structural members of diverse cross-sectional shapes so as to increase their longitudinally compressive proportionality limit (as well as elastic limit and yield strength) and thereby reduce their susceptibility to buckling. In relation to this, it is also an object of this invention to straighten elongated structural members intended for use under longitudinal compression so as to increase the member's resistance to buckling.

Another object of this invention is to increase the longitudinally tensile proportionality limit of an elongated structural member.

A further object of this invention is to provide a low cost method of increasing the ultimate compressive and tensile strengths of elongated structural members while at the same time increasing their straightness.

Yet another object of this invention is to allow the use of lighter weight and lower cost elongated structural members in applications involving highly compressive and/or tensile loads.

Still another object of this invention is to relieve residual stresses of elongated structural members.

Other objects and advantages of the invention will be apparent from the following detailed description and the accompanying drawings.

In accordance with the present invention, there is provided a method for increasing the longitudinally compressive and tensile proportionality limits and ultimate strengths of an elongated structural member by applying to the member a longitudinally compressive load. To increase the proportionality limits of the member, a longitudinally compressive load is applied to the member which is close to its maximum load. In order to prevent buckling of the member under such a load, the member is confined in an encasement which allows the member to yield longitudinally without bending. By applying to the member a longitudinally compressive load much greater than the member's original (i.e., untreated) ultimate compressive strength, both the ultimate strengths and the proportionality limits of the member are increased. In addition, application of a longitudinally compressive load close to or greater than the original ultimate compressive strength of the member also increases the straightness of the member and frees the member of residual stresses.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims. Unless otherwise stated, the terms compression and tension (or their adjective form), as used hereinafter, refer to longitudinal compression and tension.

DETAILED DESCRIPTION OF THE PREFERRED EMBODIMENT

Figure 1:
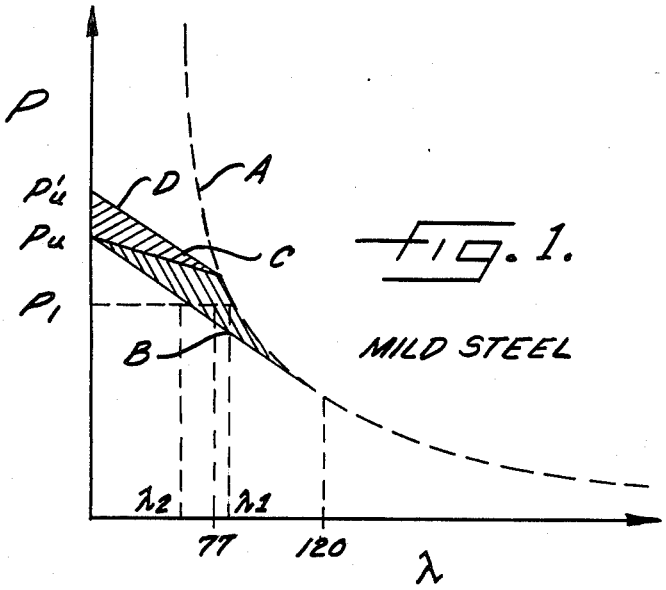
FIG. 1 is a graph depicting the critical load curves for a typical elongated structural member as predicted by Euler's equation and as modified by Tetmajer's straight line.

Referring first to FIG. 1, a graph plotting Euler's equation along the dashed curve A illustrates the critical load required to buckle a column under axial compression. (A column as referred to herein is an elongated structural member). The ordinate of the graph in FIG. 1 is the longitudinally compressive load P applied to the column in pounds per square inch. The abscissa of the graph is the ratio between the length of the column in inches and its radius of gyration in inches. This ratio is commonly referred to as the slenderness of a column and is symbolized by $\lambda$.

According to Euler's equation, the critical load $P_c$ at which a column buckles is defined as:

$$P_c = \frac{\pi^2 E}{(K\lambda)^2}$$

where E is the Young's modulus for the material under compression, λ is the slenderness of the column (i.e., the ratio between the length and radius of gyration of the column) and K is a constant representing the column's end conditions.

Figure 2:
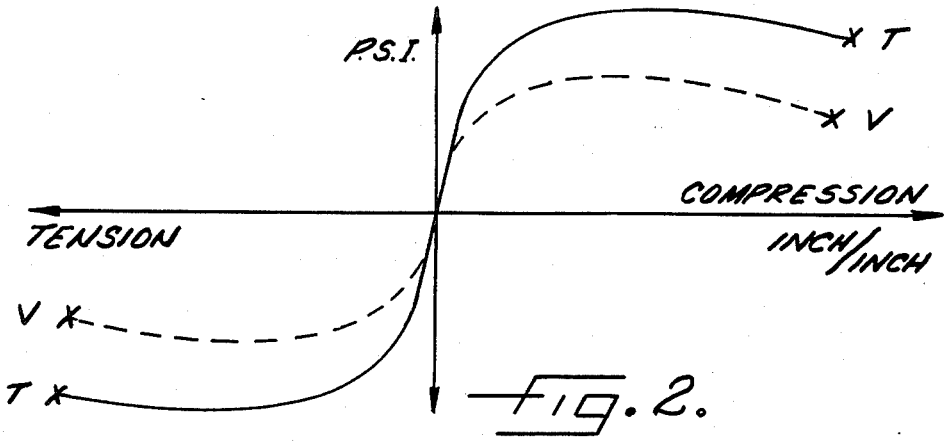
FIG. 2 is a stress-strain graph depicting curves for an elongated structural member before and after treatment by the method according to the invention.

In the stress-strain diagram of a mild steel in FIG. 2, the Young's modulus E for compression is equal in magnitude to the slope of the diagram's curve within the elastic limit (i.e., that portion of the curve which is linear). From the Young's modulus E for a material, Euler's equation predicts the critical-compressive load curve shown by the dashed curve A in FIG. 1.

For short columns (e.g., small values of λ), Euler's equation is inaccurate and Tetmajer's formula provides a better prediction of a short column's critical load. As shown by the solid line B in FIG. 1, Tetmajer's formula predicts that mild steel will have a critical load under compression that is less than predicted by Euler's equation for λ values less than 120. For the case of λ less than two or three, the critical-compressive load for a column, as shown by the Tetmajer line B in FIG. 1, is equivalent to the ultimate compressive strength $P_u$ of the column.

From the point of view of the theoretical elastic limit for a mild steel column predicted by Euler's equation, the elongated structural members need to be "overdesigned" for λ values less than 120. As can be seen from the graph in FIG. 1, for a mild steel column of fixed length and a required critical compressive load strength of $P_1$, the column must have a cross-sectional area, or thickness, greater than what Euler's equation indicates as necessary. In order to sustain the load $P_1$ without buckling, its slenderness must have a value of $\lambda_2$, instead of the theoretically possible $\lambda_1$. Typically, for members or columns made from a particular type of metal (e.g., mild steel), those which are more slender (i.e., a greater λ value) are less expensive than those which are less slender. Moreover, when used in a transportation application, a more slender column is lighter and therefore aids fuel efficiency.

As the stress-strain diagram shown in FIG. 2 illustrates, a column treated by the method according to the invention will exhibit both increased proportionality limits (i.e., the linear portion of the plotted curve) and ultimate strengths in compression and tension. The dashed curve V in FIG. 2 illustrates the stress-strain relationship of a virgin column. After treatment by the method according to the invention, the same column exhibits a stress-strain relationship shown by the solid line T in FIG. 2.

In accordance with one important aspect of the present invention a longitudinally compressive load, which is greater than the compressive elastic limit of the column, is applied to the longitudinal ends of a column such that the column yields longitudinally without buckling to thereby increase the proportionality limit (and also the elastic limit and yield strength) of the column both in compression and tension. An increase of the longitudinally compressive load to a level in excess of the column's ultimate strength, increases both the column's compressive and tensile elastic limits and its compressive ultimate strength. A further increase in the longitudinally compressive load to a level much higher than the ultimate strength of the column material (i.e., two times as great), results in an increase in both elastic limits and also an increase in the ultimate strength in both compression and tension.

Figure 3A:
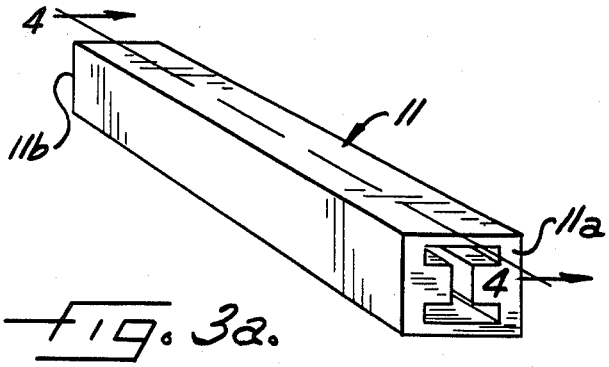
FIGS. 3*a*, 3*b* and 3*c* are perspective views of rectangular encasements utilized to confine an elongated structural member positioned therein in accordance with the invention.
Figure 3B:
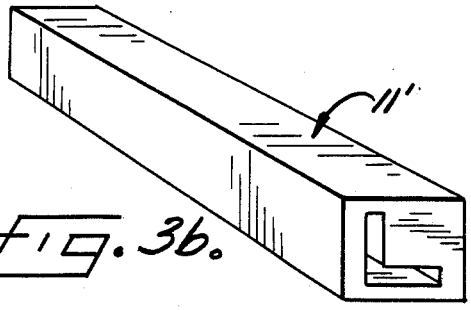
Figure 3C:
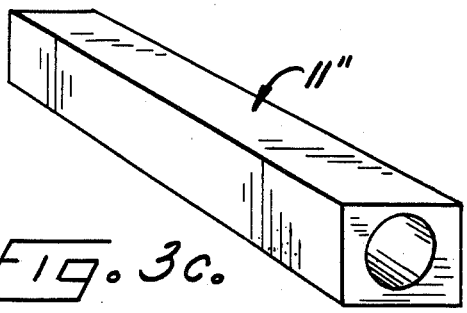

If an infinitesimally small perpendicular deformation is produced on an axially loaded column, the external moment caused by a sufficiently great axial load will be greater than the internal moment of the column, thus causing the column to exceed its buckling capacity. As a result, the column bends and buckles. In order to avoid buckling during compressive loading in accordance with the invention, encasements such as the blocks shown in FIGS. 3*a*–3*c* are secured about the outer surface of the column so as to prevent the column from bending. Because of the confined area of the cavity, bending is inhibited so that the external moment of the column is controlled and buckling is prevented. As a result, the column yields in a plastic-like flow which causes a smoothing of column irregularities such that there is a general conformance of the column surface to the surface of the cavity. Thin areas in the column cross-section become thicker, thus giving a more even distribution of material over the length of the column.

In the particular encasement shown in FIG. 3*a*, an I-beam cavity is formed inside a block 11. The I-beam cavity follows the axial length of the block 11 and is open at both the front end 11*a* and the back end 11*b* so that an I-beam can be inserted into the cavity and compressed therein. The block 11 is formed of rigid material that has a greater critical compressive strength than that of the column inserted inside the block. Therefore, the walls of the cavity in the block 11 will not yield at a compressive load sufficient to cause the column to yield. In order to provide lateral support for a column under treatment, the shape and size of the block's cavity closely conform to that of the column. Many other possible column cross-sectional shapes could also benefit from the invention as shown by the L-cavity block 11′ and the cylindrical cavity block 11″ in FIGS. 3*b* and 3*c*, respectively.

Figure 4:
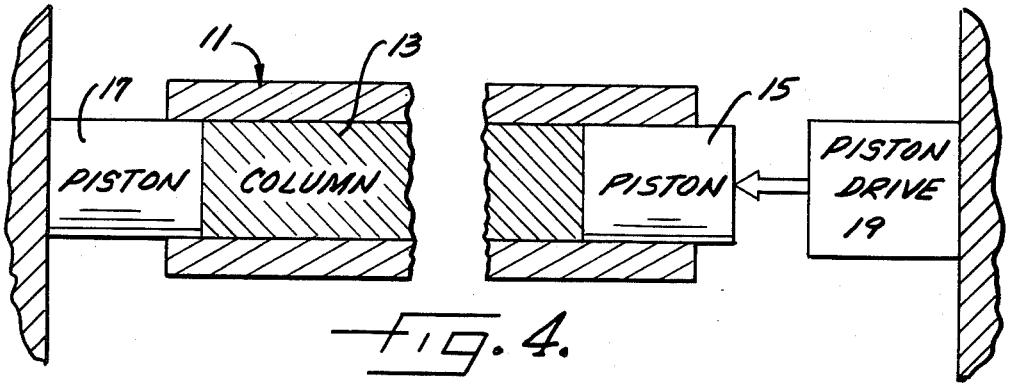
FIG. 4 is a cross-sectional view taken along the line 4—4 in FIG. 3*a* showing an elongated structural member positioned in the rectangular encasement with two opposing compression pistons positioned against the opposite ends of the member at the open ends of the encasement.

In order to apply the compressive load to the column, pistons 15 and 17 in FIG. 4, which have a cross-sectional shape the same as the column 13, are inserted into the cavity of the block 11 at its opposing ends and driven relatively toward each other by a piston drive 19. It will be appreciated that just as each differently shaped column requires its own block, it also requires its own set of pistons 15 and 17.

By applying a longitudinally compressive load of a magnitude approximately equal to the ultimate compressive strength of a mild steel column, the elastic region of the column is substantially increased as demonstrated by line C and the cross-hatched area in FIG. 1. By increasing the elastic region of the mild steel column, Euler's equation accurately describes the behavior of the treated column to a higher pressure than it describes an untreated column. Specifically, treated columns of mild steel follow the hyperbola predicted by Euler's equation to as small a λ value as 77. As can be seen by line C in FIG. 1, the ultimate strength $P_u$ of the treated mild steel columns is not affected by longitudinal compression of the same magnitude as the ultimate strength $P_u$. But, as shown by line D, longitudinal compression of the column in accordance with the invention at a load magnitude much greater than the ultimate strength $P_u$ will increase the ultimate strength of the column to a new value $P'_u$, which is much greater than $P_u$. The area between lines C and D is shaded to indicate the increase in the elastic zone and ultimate strength gained by longitudinal compression at a load much greater than the ultimate strength $P_u$.

By way of example, for a mild steel column with an ultimate strength of 60,000 p.s.i., a longitudinally compressive load of 140,000 p.s.i. will increase the column's ultimate compressive strength by approximately 70% and its ultimate tensile strength by approximately 30%. Placement of the column into the encasement elastically straightens the column by placing residual stresses on non-linear areas of the column. As the longitudinally compressive load on the mild steel column is steadily increased from no load to full load, the column first yields longitudinally at a load less than the ultimate compressive strength of the column, thus causing the mild steel to flow so as to relieve the residual stresses and redistribute material more evenly along the column's length (i.e., straighten the column). As the load approaches the ultimate compressive strength of the column, there is a significant increase in the elastic limit of the column and also a significant increase in the column's straightness. Further increases in the load, up to 140,000 p.s.i., cause the mild steel column to increase in ultimate strength both in tension and compression as stated. By so increasing the ultimate strengths of the column, its susceptibility to buckling and metal fatigue is reduced.

By treating the column in this manner, the non-linearities in the column are reduced in a single application of pressure. By increasing the linearity of the column (as well as increasing its elastic limit and ultimate strength), a significant increase in the column's resistance to buckling will result. Accordingly, columns can be made more slender (i.e., made out of less material), thereby reducing the cost of a column needed to meet predetermined stress specifications. In addition, by increasing a column's resistance to buckling, use of lower cost material to comprise the column may be possible in some applications.

Figure 5:
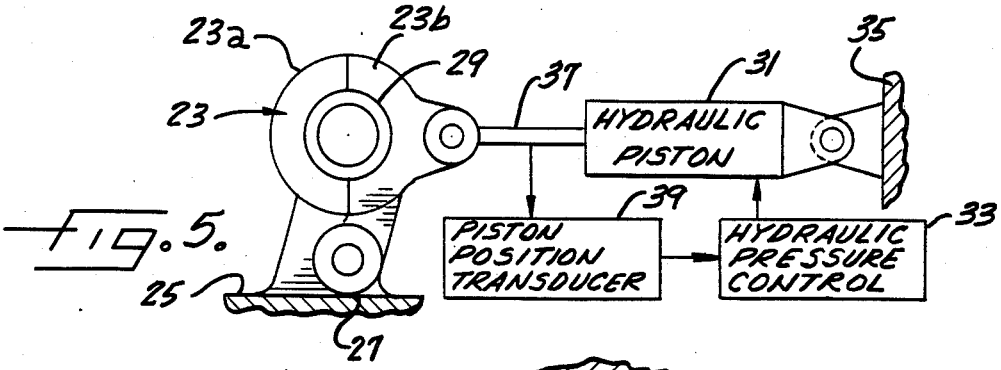
FIG. 5 is a first alternative embodiment of the encasements in FIGS. 3*a*, 3*b* and 3*c*.

In order to allow for fast operation, it is desirable to provide an encasement which may be opened and closed for easy insertion and removal of a column. Also, because of dimensional tolerances in columns, it is desirable to provide an encasement which can be adjusted for small variations in the column size. One such encasement is shown in FIG. 5 which illustrates an encasement 23 divided into two equal mating sections, 23*a* and 23*b*, and secured to a foundation 25. The cavity of the encasement 23 can be exposed by pivoting the encasement section 23*b* about a pivot 27 so as to allow a column 29 to be laid into the cavity. In order to open and close the encasement, a hydraulic piston 31 controls the movement of the pivoting encasement section 23*b*. A hydraulic pressure control circuit 33 controls the pressure within the hydraulic piston 31 so that the piston 31, working against a foundation 35, pushes out a piston arm 37, thus causing the pivoting encasement section 23*b* to close with the fixed section 23*a*.

Because of size tolerances in the columns laid into the cavity, the precise position of the pivoting encasement section 23*b*, when it closes on the column and contacts it, may vary with individual columns. In order to correctly position the pivoting encasement section 23*b* when closed, hydraulic pressure control circuit 33 senses the increased pressure when pivoting encasement section 23*b* contacts the column 29. By positioning the pivoting encasement section 23*b* in this manner, small variations in size of the column can be accommodated by the encasement while still maintaining the encasement function of satisfactorily supporting the column in order to prevent buckling.

In order to prevent the opening of the pivoting encasement section 23*b* as longitudinal pressure is applied to the column 29, the hydraulic pressure in the hydraulic piston 31 must be increased as radial pressure mounts. To provide for this, a piston position transducer 39 is coupled to the piston arm 37 so as to provide the hydraulic pressure control circuit 33 with a signal indicative of the position of the pivoting encasement section 23*b*. In response to the position signal from the transducer 39, the hydraulic pressure control circuit 33 adjusts the pressure within the hydraulic piston 31 so as to hold the pivoting encasement section 23*b* in a steady position.

In some column applications, such as well casings, a slight deformation of a column's surface, which might be caused by a longitudinal compression that is not totally radially restrained, is not of great concern. For such columns, the encasement shown in FIG. 6 can provide adequate confinement and support so as to prevent buckling of the column when it is subjected to the high longitudinal loads in accordance with the invention. At high longitudinally compression loads (e.g., close to the ultimate strength) radial bulges will occur on the surface of the column where the encasement does not restrain the radial yielding of the column. In the case of the cylindrical column 41 in FIG. 6, the treated column will have a slightly out-of-round cross-section.

Figure 6:
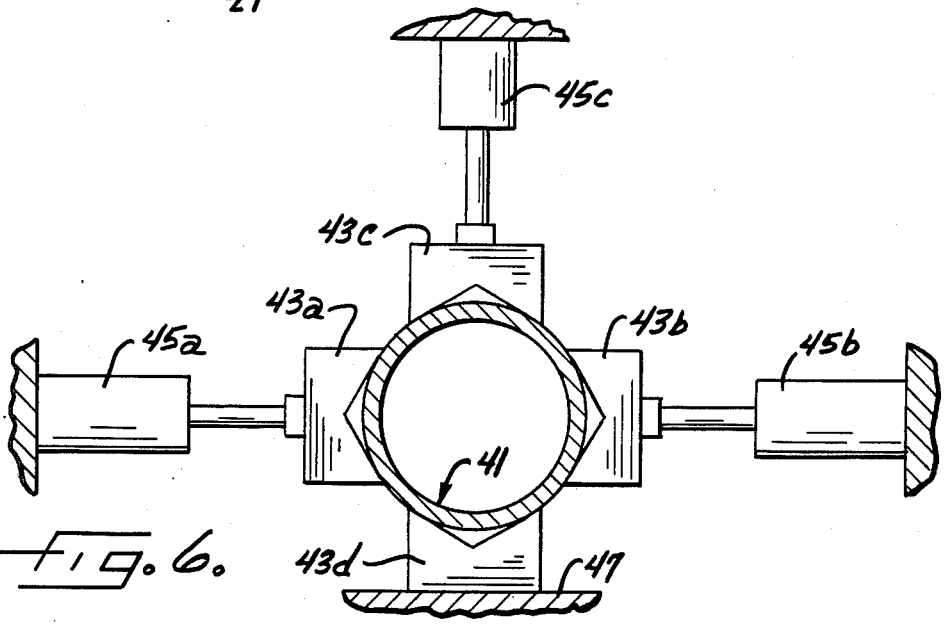
FIG. 6 is a second alternative embodiment of the encasements in FIGS. 3*a*, 3*b* and 3*c*.

Two pairs of opposing blocks, 43*a*, 43*b* and 43*c*, 43*d*, provide the encasement in FIG. 6 which prevents buckling of the column when a high longitudinal load is applied to the column 41. Each block has a wedge cut surface so as to accommodate various sizes of cylindrical columns. Also to accommodate various column sizes, blocks 43*a*, 43*b* and 43*c* are mounted on hydraulic pistons 45*a*, 45*b*, and 45*c*, respectively. Block 43*d* is secured to a foundation 47. Positioning of hydraulic pistons 45*a*, 45*b* and 45*c* is accomplished in a manner similar to that described in connection with FIG. 5. It should be noted that although four blocks are illustrated in FIG. 6, the specific number may be varied.

Figure 7:
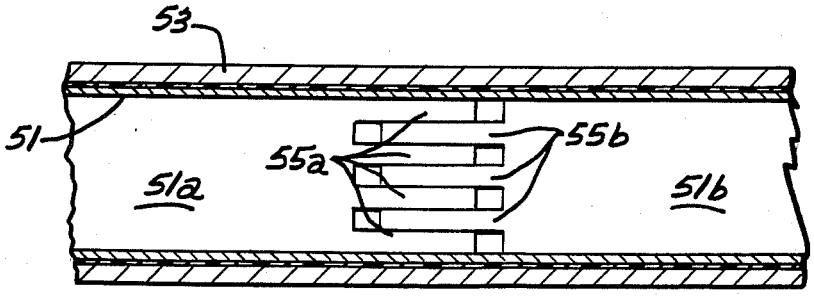
FIG. 7 is a third alternative embodiment of the encasements in FIGS. 3*a*, 3*b* and 3*c*.

In order to reduce friction between the column and its encasement, FIG. 7 illustrates an encasement 51 having two sections 51*a* and 51*b* connected by interlocking fingers 55*a* and 55*b* and mounted within an outer sheath 53. Compression of a column within the encasement 51 causes the encasement to move with the column within the sheath 53, thereby causing the interlocking fingers 55 to close as the column is compressed. By reducing the relative movement between the encasement 51 and the column, the friction between the column and the encasement is also reduced. As a result, there is a more uniform yielding along the length of the column. To reduce the friction between the encasement 51 and the sheath 53, an anti-friction lining can be added. For example, a lining of Teflon could be included between the encasement 51 and sheath 53. Linear roller bearings or an oil film under pressure are also possible linings.

From the foregoing, it will be appreciated that the application of a longitudinal load to a column in accordance with the invention provides a simple and inexpensive method of (1) increasing the proportionality limits of a column, (2) increasing the ultimate strengths of a column and (3) increasing the straightness of a column while removing the residual stresses therein. By so providing, the invention allows columns to be utilized closer to their theoretical limits.

I claim:

1. A method for increasing the compressive and tensile proportionality limits, elastic limits and yield strengths of an elongated structural member, said method comprising the steps of:

providing an elongated structural member having a lengthwise dimension that substantially exceeds any transverse cross-sectional dimension of said member, said member having at least one outer longitudinal surface;

providing an encasement having an inner longitudinal surface that corresponds to and substantially conforms to each outer longitudinal surface of said member;

confining said member within said encasement so as to substantially prevent deformation of said member in all directions transverse to the longitudinal axis of said member;

applying a compressive load to said member with said load being parallel to said longitudinal axis;

increasing said load to a magnitude greater than the original compressive elastic limit of said member;

allowing said member to yield in a direction parallel to said longitudinal axis;

producing, as a result of said yielding, a smoothing of surface irregularities on said longitudinal surface of said member such that there is a general conformance of the outer longitudinal surface of said member to the inner longitudinal surface of said encasement, and (b) a thickening of thin areas in the member's cross-section thus producing a more even distribution of material over the length of the member; and preventing said member from buckling or from bending in all of said transverse directions throughout the course of said applying and increasing steps.

2. A method as recited in claim 1 wherein:

said compressive load is increased to a magnitude greater than the original compressive ultimate strength of said member so as to additionally increase the ultimate compressive strength of said member.

3. A method as recited in claim 1 wherein:

said compressive load is increased to a magnitude sufficiently greater than the original compressive ultimate strength of said member so as to additionally increase the ultimate compressive and tensile strengths of said member.

4. A method as recited in claim 1 wherein said applying step comprises:

providing a piston;

urging said piston against one end of said member; and restraining the other end of said member from movement parallel to said longitudinal axis.

5. A method as recited in claim 1 wherein said applying step comprises:

providing a pair of opposing pistons; and urging each of said pair of opposing pistons against a respective opposite end of said member.

6. A method for increasing the elastic region of an elongated structural member and for increasing the critical load of said elongated structural member to a value more accurately predicted by Euler's equation, $$P_c = \frac{\pi^2 E}{K\lambda^2}$$

wherein $P_c$ equals the critical load of said member, E equals the Young's modulus of the material comprising said member, K is a constant representing end conditions of said member, and $\lambda$ equals the ratio between the length of said member and its radius of gyration, said method comprising the steps of:

providing an elongated structural member having a lengthwise dimension that substantially exceeds any transverse cross-sectional dimension of said member, said member having at least one outer longitudinal surface;

providing an encasement having an inner longitudinal surface that corresponds to and substantially conforms to said each longitudinal surface of said member;

confining said member within said encasement so as to substantially prevent deformation of said member in all directions transverse to the longitudinal axis of said member;

applying a compressive load to said member with said load being parallel to said longitudinal axis;

increasing said load to a magnitude at least approximately equal to the original compressive ultimate strength of said member;

allowing said member to yield in a direction parallel to said longitudinal axis;

producing, as a result of said yielding, (a) a smoothing of surface irregularities on said longitudinal surface of said member such that there is a general conformance of the outer longitudinal surface of said member to the inner longitudinal surface of said encasement, and (b) a thickening of thin areas in the member's cross-section thus producing a more even distribution of material over the length of the member; and preventing said member from buckling or from bending in all of said transverse directions throughout the course of said applying and increasing steps.

7. A method for improving the straightness of an elongated structural member and for relieving the residual stresses therein, said method comprising the steps of:

providing an elongated structural member having a lengthwise dimension that substantially exceeds any transverse cross-sectional dimension of said member, said member having at least one outer longitudinal surface;

providing an encasement having an inner longitudinal surface that corresponds to and substantially conforms to each outer longitudinal surface of said member;

confining said member within said encasement so as to substantially prevent deformation of said member in all directions transverse to the longitudinal axis of said member;

applying a compressive load to said member with said load being parallel to said longitudinal axis;

increasing said load to a magnitude greater than the original compressive elastic limit of said member;

allowing said member to yield in a direction parallel to said longitudinal axis;

producing, as a result of said yielding, (a) a smoothing of surface irregularities on said longitudinal surface of said member such that there is a general conformance of the outer longitudinal surface of said member to the inner longitudinal surface of said encasement, and (b) a thickening of thin areas in the member's cross-section thus producing a more even distribution of material over the length of the member; and preventing said member from buckling or from bending in all of said transverse direction throughout the course of said applying and increasing steps.

8. A method for improving the cross-sectional uniformity of an elongated structural member, said method comprising the steps of:

providing an elongated structural member having a lengthwise dimension that substantially exceeds any transverse cross-sectional dimension of said member, said member having at least one outer longitudinal surface;

providing an encasement having an inner longitudinal surface that corresponds to and substantially conforms to each outer longitudinal surface of said member;

confining said member within said encasement so as to substantially prevent deformation of said member in all directions transverse to the longitudinal axis of said member;

applying a compressive load to said member with said load being parallel to said longitudinal axis;

increasing said load to a magnitude greater than the original compressive elastic limit of said member;

allowing said member to yield in a direction parallel to said longitudinal axis;

producing, as a result of said yielding, (a) a smoothing of surface irregularities on said longitudinal surface of said member such that there is a general conformance of the outer longitudinal surface of said member to the inner longitudinal surface of said encasement, and (b) a thickening of thin areas in the member's cross-section thus producing a more even distribution of material over the length of the member; and preventing said member from buckling or from bending in all of said transverse directions throughout the course of said applying and increasing steps.

9. An apparatus for causing an improvement in the strength, straightness and cross-sectional uniformity of an elongated structural member having a lengthwise dimension that substantially exceeds any transverse cross-sectional dimension of said member, the member having at least one outer longitudinal surface, said apparatus comprising:

an encasement means surrounding each outer longitudinal surface of said member along the entire length of said member to prevent said member from buckling or bending, said encasement means having an inner longitudinal surface that is sufficiently close to each outer longitudinal surface of said member so as to substantially prevent deformation of said member in all directions transverse to the longitudinal axis of said member;

means for applying to said member a compressive load parallel to said longitudinal axis;

means for increasing said compressive load to a magnitude greater than the original compressive elastic limit of said member;

means for allowing said member to yield in a direction parallel to said longitudinal axis; and means for producing, as a result of said yielding, (a) a smoothing of surface irregularities on said longitudinal surface of said member such that there is a general conformance of the outer longitudinal surface of said member to the inner longitudinal surface of said encasement, and (b) a thickening of thin areas in the member's cross-section thus producing a more even distribution of material over the length of the member.

10. The apparatus of claim 9 wherein said encasement comprises:

at least two transversely adjacent mating sections.

11. The apparatus of claim 10, and further comprising:

means for moving at least one of said mating sections transversely away from the other sections to an encasement-open position and transversely towards said other sections to an encasement-closed position; and means for urging said sections against the longitudinal surfaces of said member when said sections are in the encasement-closed position.

12. The apparatus of claim 9 wherein said encasement comprises:

at least two longitudinally adjacent sections mounted within an outer sheath; and means for allowing said adjacent sections to move longitudinally relative to each other so as to reduce friction between said member and said encasement.

13. The apparatus of claim 12 wherein said allowing means comprises:

longitudinally-extending interlocking mating fingers at the adjacent ends of said sections; and a lining between said encasement and said sheath, said lining comprising means for reducing the friction between said encasement and said sheath.

14. The apparatus of claim 9 wherein said applying means comprises:

a piston means adjacent one end of said member;

means for urging said piston means against said one end of said member in a direction parallel to the longitudinal axis of said member; and means adjacent the end of said member opposite said one end for restraining said opposite end against movement parallel to said longitudinal axis.

15. The apparatus of claim 9 wherein said applying means comprises:

a piston means adjacent each end of said member; and means for urging each of said piston means against a respective opposite end of said member in a direction parallel to the longitudinal axis of said member.

16. A method for increasing the strength and straightness of an elongated structural member, said method comprising the steps of:

providing an elongated structural member having a lengthwise dimension that substantially exceeds any transverse cross-sectional dimension of said member, said member having at least one outer longitudinal surface;

urging a plurality of transversely-opposing member restraining blocks against a respective longitudinal surface of said member;

applying a compressive load to said member with said load being parallel to the longitudinal axis of said member;

increasing said load to a magnitude greater than the original compressive elastic limit of said member;

allowing said member to yield in a direction parallel to said longitudinal axis; and preventing said member from buckling or from bending in all of said transverse directions throughout the course of said applying and increasing steps.

17. An apparatus for causing an improvement in the strength and straightness of an elongated structural member having a lengthwise dimension that substantially exceeds any transverse cross-sectional dimension of said member, the member having at least one outer longitudinal surface, said apparatus comprising:

means for urging a plurality of transversely-opposing member restraining blocks against a respective longitudinal surface of said member to prevent said member from buckling or bending;

means for applying to said member a compressive load parallel to the longitudinal axis of said member;

means for increasing said compressive load to a magnitude greater than the original compressive elastic limit of said member; and means for allowing said member to yield in a direction parallel to said longitudinal axis to make said member stronger and straighter.

18. The apparatus of claim 17 wherein:

each of said restraining blocks comprises a wedge-cut, member-contacting, face means for accommodating members of varying cross-section.

* * * * *